US006003599A

United States Patent [19]

Huber et al.

[11] Patent Number: 6,003,599

[45] Date of Patent: Dec. 21, 1999

[54] AZIMUTH-ORIENTED PERFORATING SYSTEM AND METHOD

[75] Inventors: Klaus B. Huber; Joe C. Hromas, both of Sugar Land, Tex.

[73] Assignee: Schlumberger Technology Corporation, Sugar Land, Tex.

[21] Appl. No.: 08/929,431

[22] Filed: Sep. 15, 1997

[51] Int. Cl.[6] ..... E21B 43/119

[52] U.S. Cl. ..... 166/255.2; 166/55.1; 166/297; 175/4.51

[58] Field of Search ..... 166/55.1, 297, 166/252.2, 255.2, 255.3; 175/4.51, 4.52

[56] References Cited

U.S. PATENT DOCUMENTS

| | | | |
|---|---|---|---|
| 2,679,898 | 6/1954 | Forsyth et al. | 175/4.51 |
| 3,143,170 | 8/1964 | Nelson | 175/4.51 |
| 3,414,071 | 12/1968 | Alberts | 175/4.51 |
| 3,704,749 | 12/1972 | Estes et al. | 175/4.51 |
| 4,307,780 | 12/1981 | Curington | 166/113 |
| 4,744,416 | 5/1988 | Bower | 166/253 |
| 5,010,964 | 4/1991 | Cornette | 175/4.51 |
| 5,025,861 | 6/1991 | Huber et al. . | |
| 5,095,993 | 3/1992 | Huber et al. . | |
| 5,259,466 | 11/1993 | Venditto et al. | 175/4.51 |
| 5,293,940 | 3/1994 | Hromas et al. . | |
| 5,318,126 | 6/1994 | Edwards et al. . | |
| 5,335,724 | 8/1994 | Venditto et al. | 166/298 |
| 5,366,013 | 11/1994 | Edwards et al. . | |
| 5,394,950 | 3/1995 | Gardes | 175/45 |
| 5,429,192 | 7/1995 | Huber et al. . | |

OTHER PUBLICATIONS

"Perforator Orientation Tool (POT–CA)", Schlumberger Technology Corporation, Feb. 7,1996, (1 page).

Excerpts from "Schlumberger Perforating Services", Schlumberger Wireline & Testing Services, 1995, pp. iii–x, 4–36, 4–56, 7–7 and 9–27 through 9–30 (15 pages).

"Gun Orienting in Multiple String Completions" by Pat Finnegan, The Perforating and Testing Review, vol. 6, No. 1, Mar. 1993, (11 pages).

*Primary Examiner*—Hoang Dang

*Attorney, Agent, or Firm*—Jeffrey E. Griffin; Jaime A. Castano; John J. Ryberg

[57] ABSTRACT

An apparatus for positioning a tool, such as a perforating gun, in a wellbore to orient the tool in a desired direction. An anchor having a first reference terminal is set in the wellbore, the first reference terminal pointing in a known direction. A second reference terminal is attached to the tool, the second reference terminal being coupled to the first reference terminal to orient the tool in the desired direction. A gyroscope measures the direction of the first reference terminal with respect to the magnetic north. The perforating gun includes charges arranged to perform perforating along a preferred fracture plane, such as 0°- or 180°-phased perforating.

16 Claims, 8 Drawing Sheets

AZIMUTH-ORIENTED PERFORATING SYSTEM AND METHOD

BACKGROUND

The invention relates to an azimuth-oriented perforating system.

After a well has been drilled and casing has been cemented in the well, one or more portions of the casing adjacent pay zones are perforated to allow fluid from the surrounding formation to flow into the well for production to the surface. Perforating guns may be lowered into the well and the guns fired to create openings in the casing and to extend perforations into the surrounding formation.

Generally, logging techniques are used to determine locations of pay zones in the formation surrounding a drilled wellbore. Among the measurements taken of the formation is its permeability. Sometimes, the permeability of the formation is too low to produce any meaningful amount of producible fluid. In many cases, such low permeability formations, even though they may contain producible fluids, are not exploited.

SUMMARY

In general, in one aspect, the invention features an apparatus for positioning a tool in a wellbore to orient the tool in a desired direction. The apparatus includes an anchor having a first reference terminal set in the wellbore, the first reference terminal pointing in a known direction. A second reference terminal is attached to the tool, the second reference terminal being coupled to the first reference terminal to orient the tool in the desired direction.

Implementations of the invention may include one or more of the following features. The first terminal includes a female reference slot, and the second reference terminal includes a male reference member. A gyroscope is used to measure the direction of the first reference terminal with respect to the magnetic north. The anchor is set in the wellbore before the gyroscope makes its measurement. The second reference terminal is adjustable to face in a direction based on the measurement taken by the gyroscope. The tool includes a perforating gun, which includes charges arranged to perform perforating along a preferred fracture plane. The charges are arranged to perform 0°- or 180°-phased perforating.

In general, in another aspect, the invention features an apparatus for setting a reference terminal having a known azimuth direction in a wellbore. The apparatus includes an anchor that is set in the wellbore and having a reference terminal. A gyroscope is fixed with respect to the anchor for measuring the azimuth orientation of the referenced terminal in the anchor.

In general, in another aspect, the invention features an apparatus for perforating in a selected direction in a wellbore. The apparatus includes a perforating gun and a gyroscope coupled to the perforating gun for measuring the azimuth orientation of the perforating gun. The perforating gun is rotatable to point in a selected direction.

In general, in another aspect, the invention features an apparatus for perforating in a selected direction in a wellbore. The apparatus includes an anchor having a first reference terminal. A gyroscope measures the azimuth orientation of the first reference terminal. A perforating gun is attached to a second reference terminal, the second reference terminal being coupled to the first reference terminal to orient the perforating gun to fire in the selected direction.

In general, in another aspect, the invention features a method of positioning a tool in a selected azimuth orientation in a wellbore. An anchor having a reference terminal is set. The azimuth orientation of the reference terminal is measured. The tool is coupled to the reference terminal to orient the tool in the selected azimuth orientation.

Implementations of the invention may include one or more of the following advantages. Permeability of a formation is improved by perforating along a single plane (the preferred fracture plane). The direction in which a perforating gun is pointing in a vertical well can be accurately determined to perform 0°- or 180°-phased perforation.

DETAILED DESCRIPTION

To improve the permeability of a formation containing producible fluids, the formation can be fractured along a plane of minimum stress, also referred to as the "preferred fracture plane." To create the fractures along the plane, 0°-phased or 180°-phased perforation is performed. In 0°-phased perforation, all the shaped charges of a perforating gun are arranged to fire in one direction. In 180°-phased perforation, the shaped charges are arranged to shoot in two opposite directions. The fractures created along the preferred plane improve the permeability of the formation in that plane and thus increase the rate of fluid flow from the formation.

Figure 1:
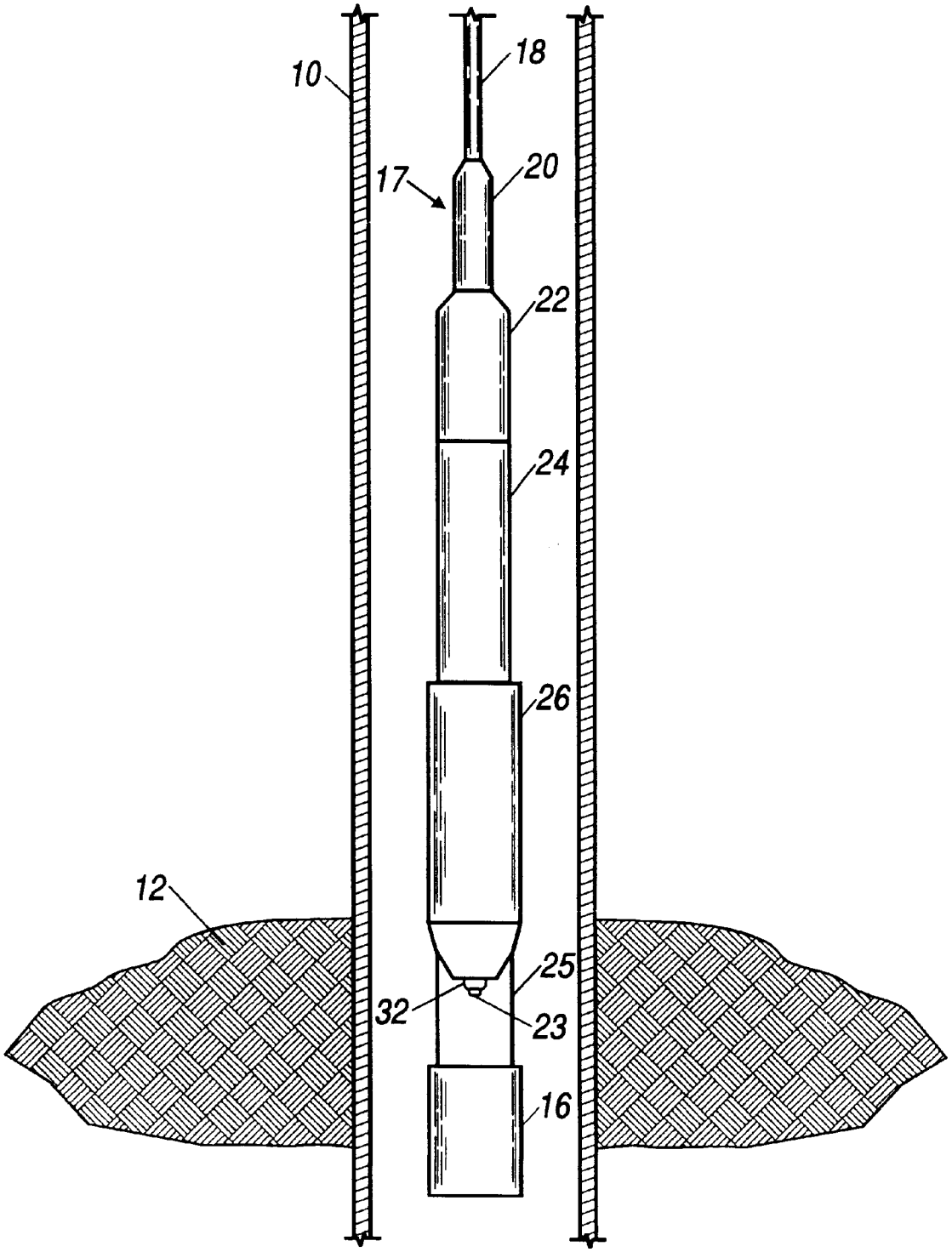
FIG. 1 is a diagram of an anchor-setting tool for setting an anchor in a wellbore.

Referring to FIG. 1, a formation 12 having producible fluids is adjacent a casing 10 in a vertical or slightly deviated well. The location of the formation 12 can be identified using any number of techniques, including open hole (OH) logging, dipole sonic imaging (DSI), or the Snider/Halco injection method (in which tracers are pumped into the formation 12 and a measurement tool is used to detect radioactivity to identify producible fluids in the surrounding formation 12).

Such logging techniques can also measure the permeability of the formation 12. If producible fluids are present but the permeability of the formation 12 is too low, the position of a preferred fracture plane can be identified with respect to the magnetic north. Next, the depth of the preferred fracture plane and its orientation with respect to the magnetic north are recorded. Using the recorded data, azimuth-oriented perforating in the preferred fracture plane (either 0°-phased or 180°-phased perforating) can be performed later.

To set up azimuth-oriented perforating, an anchor 16 is first set at the depth of the formation 12. The anchor 16 is part of an anchor-setting tool 17 lowered by a wireline 18.

Alternatively, coiled tubing can be used to lower the anchor-setting tool 17. The anchor-setting tool 17 includes a cable head 20 for connection to the wireline 18 and a casing collar locator (CCL) 22 attached beneath the cable head 20. The CCL 22 is used to correlate the depth of the anchor-setting tool 17 inside the casing 10. Communication of the depth is achieved using electrical signals transmitted up the wireline 18 to the surface.

Attached below the CCL 22 is a gyroscope 24, which is used to identify the actual orientation of the anchor-setting tool 17 with respect to the magnetic north. Because the wireline 18 is unable to keep the anchor-setting tool 17 from twisting as it is being lowered downhole, the direction or directions in which the shaped charges are pointing are unknown. Once the anchor 16 is set downhole by expanding anchor slip 62 (FIG. 4), the gyroscope 24 is used to determine the azimuth orientation of the anchor-setting tool 17 with respect to the magnetic north.

The gyroscope 24 is further attached to an anchor setting apparatus 26 which sets the anchor 16 inside the cased well 10 in response to electrical activation. An example of an anchoring system that includes an anchor and an anchor-setting apparatus is described in U.S. Pat. No. 5,429,192, entitled "Method and Apparatus for Anchoring a Perforating Gun to a Casing in a Wellbore Including a Primary and a Secondary Anchor Release Mechanism," assigned to the same assignee as the present application, and which is hereby incorporated by reference.

The bottom portion 21 of the anchor-setting apparatus 26 is coupled to a tubular female reference member 25 attached to the anchor 16. The female reference member 25 has a reference slot 32 that receives a male reference member 23 attached to the bottom portion 21 of the anchor-setting apparatus 26. The reference slot 32 in the anchor 16 in conjunction with the male reference member 23 orients the anchor-setting apparatus and gyroscope 24 to a fixed reference point after the anchor 16 is set. Thus, the measurement taken by the gyroscope 24 is taken with some known reference in the fixed anchor to allow later meaningful use of the recorded gyroscope measurements.

Although a reference slot is used in the anchor 16, other types of reference terminals can be used. For example, instead of a slot, a male reference member can be provided in the anchor 16 for mating to a female reference terminal of a tool.

Figure 3A:
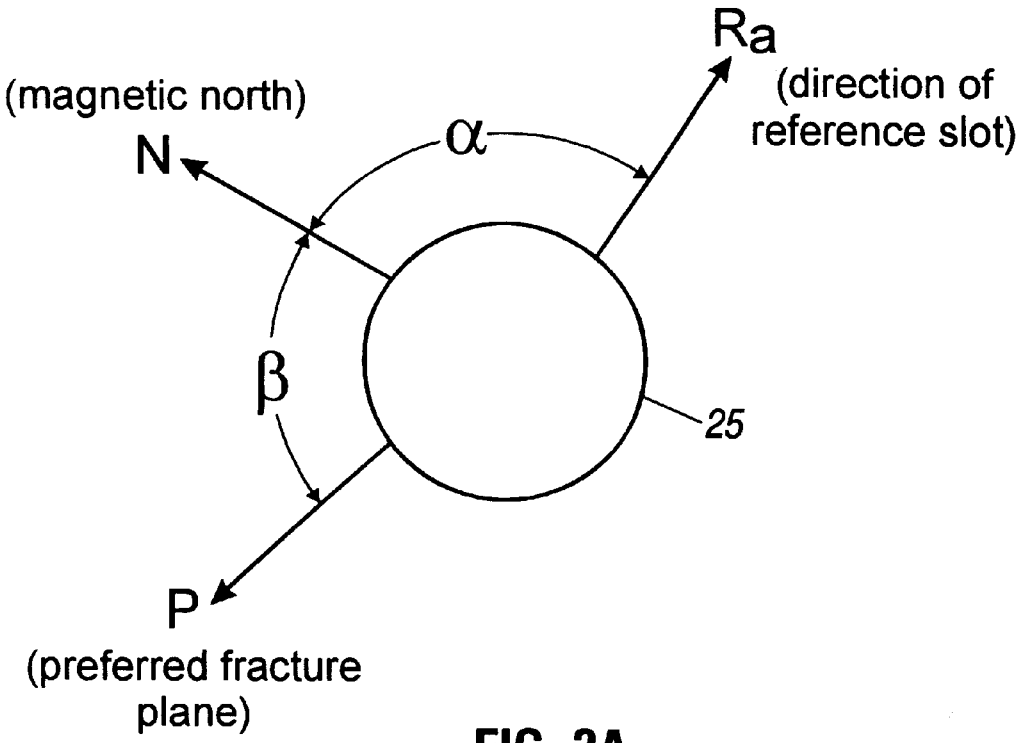
FIGS. 3*a* and 3*b* are diagrams illustrating the azimuth directions of the reference slot, the magnetic north, a preferred fracture plane, and the shaped charges in a perforating gun.

Referring to FIG. 3*a*, when the gyroscope 24 makes a measurement, it measures the angle $\alpha$ between a vector $R_a$ pointing in the direction of the reference slot 32 and a vector N pointing towards magnetic north.

After the anchor 16 is set and the appropriate measurements are recorded, the remaining components of the anchor-setting tool 17 (including the anchor-setting apparatus 26, the gyroscope 24, the CCL 22, and the cable head 20) are released from the anchor 16 and retrieved from the well. After the anchor-setting tool 17 has been retrieved from the well, a perforating gun 27 (FIG. 4) is run downhole on a perforating tool 35 for attachment to the anchor 16.

Figure 2A:
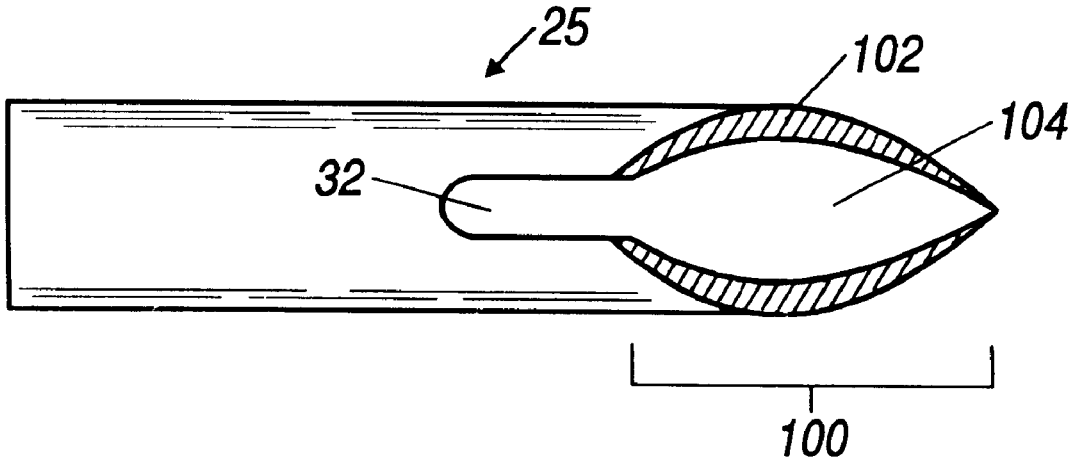
FIGS. 2*a* and 2*b* are diagrams of a female reference member having a reference slot for attachment to the anchor.
Figure 2B:
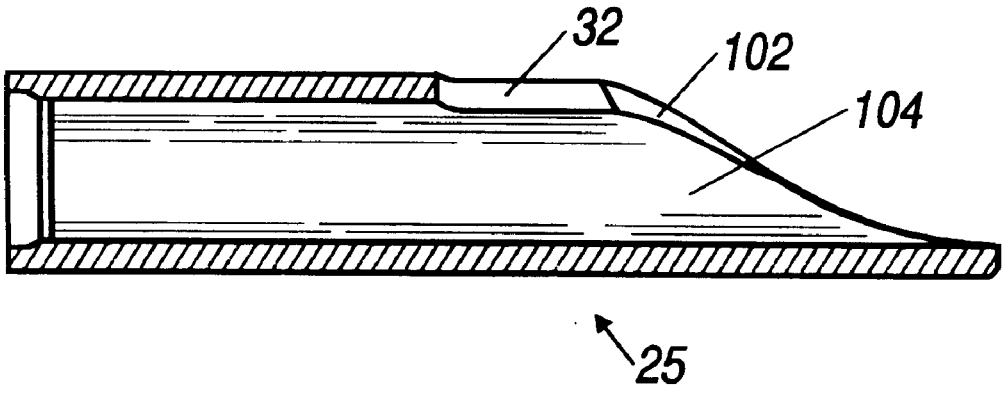

Referring to FIGS. 2*a* and 2*b*, the female reference member 25, which is attached at its bottom end to the anchor 16, is generally tubular in shape. The top portion 100 of the female reference member 25 is sliced at an angle to create a slanted face 102. The reference slot 32 is located immediately below the slanted face 102. The slanted face 102 is used to guide the bottom end of the perforating gun 27 once contact is made such that it twists to properly mate with the reference slot 32.

Figure 4:
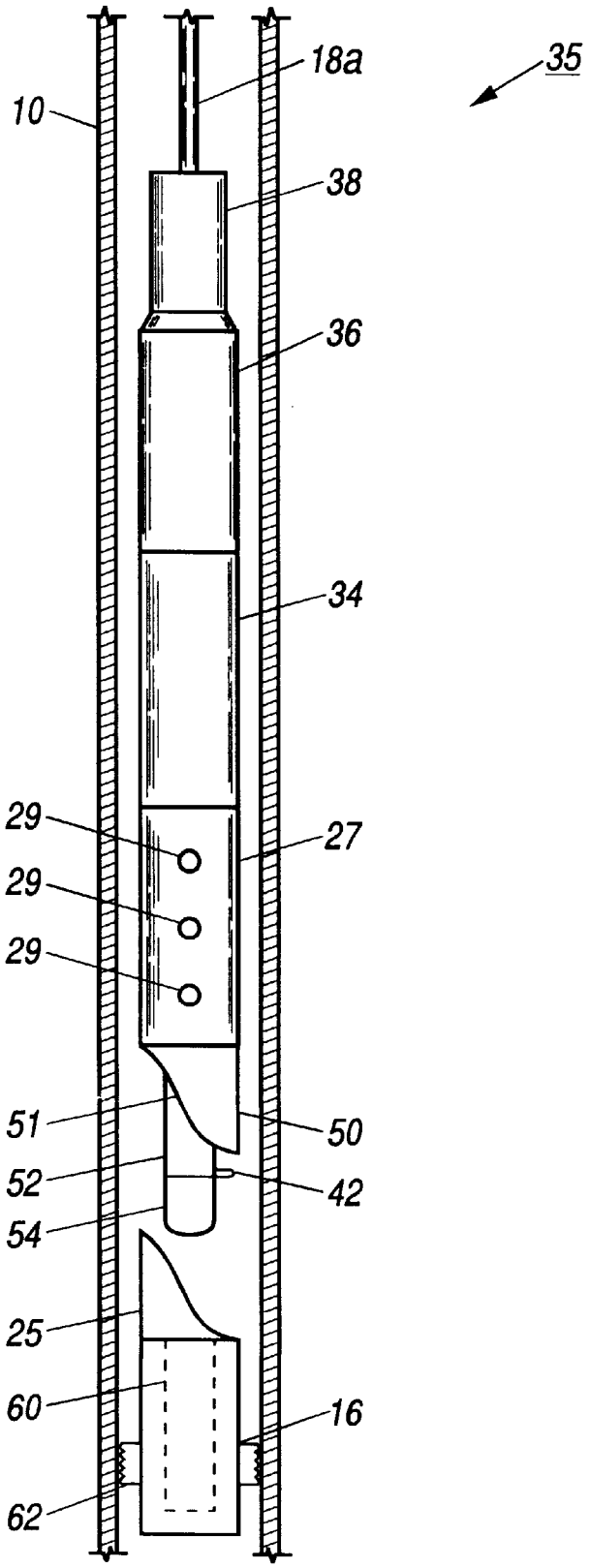
FIG. 4 is a diagram of a perforating tool lowered for coupling to the anchor.

Referring to FIG. 4, the perforating tool 35 (carrying the perforating gun 27) is lowered downhole by a wireline 18*a* to lock to the anchor 16. The anchor 16 was previously set by expanding the anchor slip 62 to grip the inner walls of the casing 10. The reference slot 32 in the female reference member 25 attached to the anchor 16 is used to aid in orienting the perforating gun 27 to face in the appropriate direction to perform 0°-phased or 180°-phased perforation in the preferred fracture plane. The perforating tool 35 includes a cable head adapter 38 for connection to the wireline 18*a*, a CCL 36 for determining the depth of the perforating tool 35 inside the casing 10, a firing head 34 connected to fire the perforating gun 27, and a reference module (including a mating member 50, a support member 52, and a male reference member 42) attached below the perforating gun 27. The bottom of the mating member 50 has a complementary slanted face 51 for mating with the slanted face 102 of the female reference member 25. As the perforating tool 35 is lowered, the complementary slanted surfaces of the female reference member 25 and mating member 50 guide the male reference member 42 into the reference slot 32.

Figure 3B:
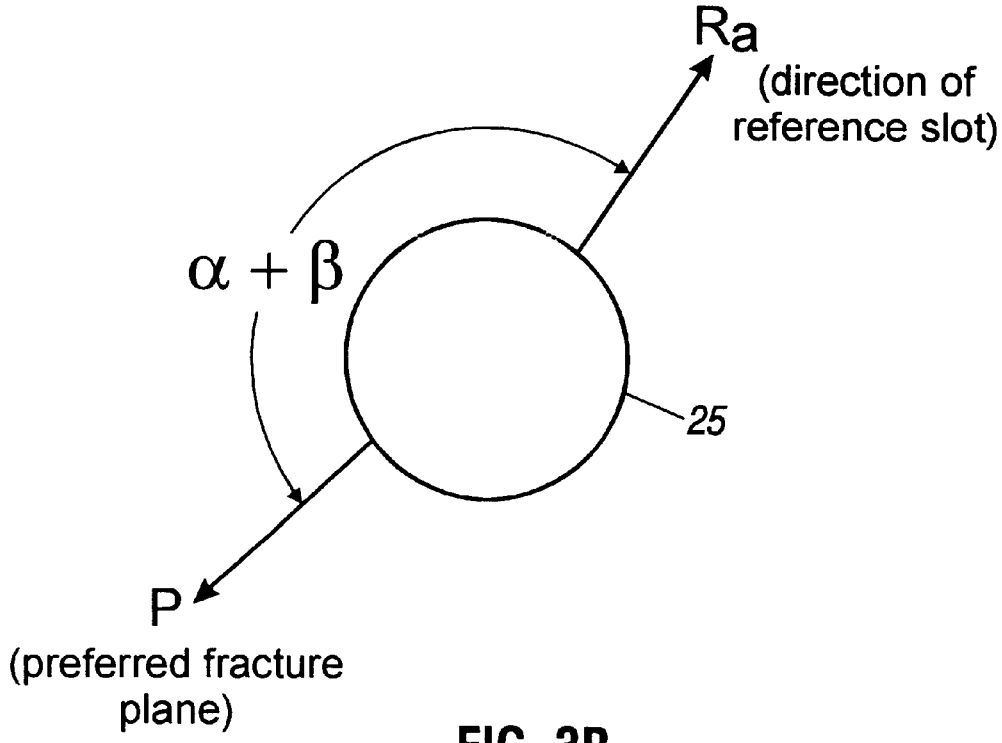

The direction that the shaped charges 29 in the perforating gun 27 face is adjusted at the well surface with respect to the direction of the male reference member 42 to correspond to the preferred fracture plane. For example, as shown in FIGS. 3*a* and 3*b*, if the preferred fracture plane extends along a vector P (through the formation 12) at an angle $\beta$ (previously recorded in a logging run) with respect to the vector N (pointing to the magnetic north), then the shaped charges of the perforating gun 27 are arranged to shoot along a vector S at an angle $(\alpha+\beta)$ from a vector $R_m$ pointing in the direction of the male reference member 42. The angle $\alpha$ was previously measured by the gyroscope 24 and is the angle between the reference slot 32 and magnetic north.

As further shown in FIG. 4, a fishing tool 54 is attached to the bottom of the support member 52 of the reference module. The fishing tool 52 passes through the female reference member 25 into a locking sleeve 60 in the anchor 16, where the fishing tool 54 locks to the anchor 16 (shown in detail in FIGS. 5, 6*a* and 6*b*). After the fishing tool 54 is locked to the anchor 16, the perforating gun 27 can be fired to shoot into the preferred fracture plane. Next the anchor 16 is released (either mechanically or ballistically). Mechanical release is accomplished by pulling up on the fishing tool 54, which releases a locking mechanism to allow well fluid pressure to lift the locking sleeve 60 and allow the anchor slip 62 to retract to unset the anchor 16.

The entire assembly (the perforating tool 35 and the anchor 16) can then be retrieved from the wellbore. Alternatively, the anchor 16 can be released and dropped to the bottom of the wellbore.

For ballistic release of the anchor 16, the detonating cord in the perforating gun 27 is extended to the anchor 16. When the gun 27 is fired, the detonation wave in the detonating cord releases the anchor 16. Details of how the anchor 16 is set and unset is described in U.S. Pat. No. 5,429,192, referenced above.

Figure 5:
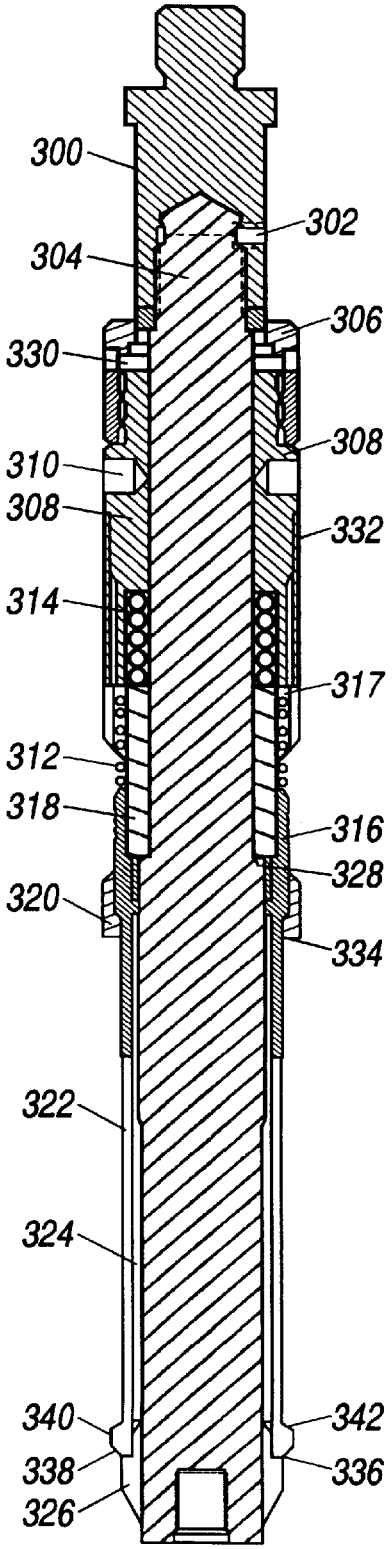
FIG. 5 is a diagram of a fishing tool.
Figure 6A:
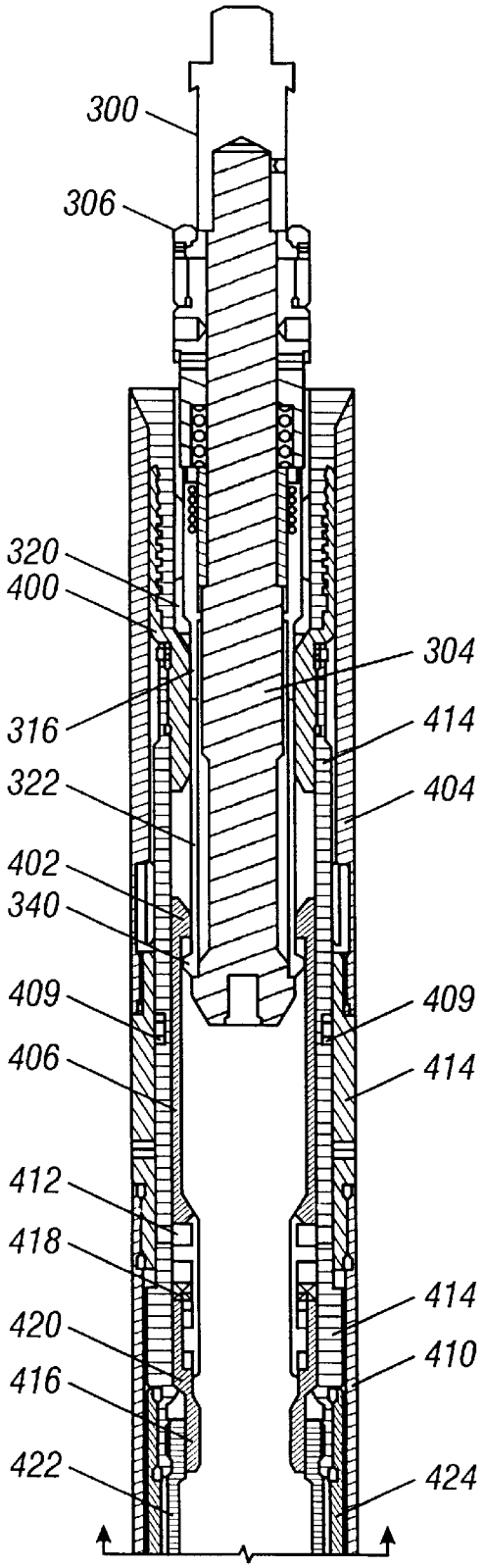
FIGS. 6*a* and 6*b* are diagrams of the fishing tool locked to the anchor.
Figure 6B:
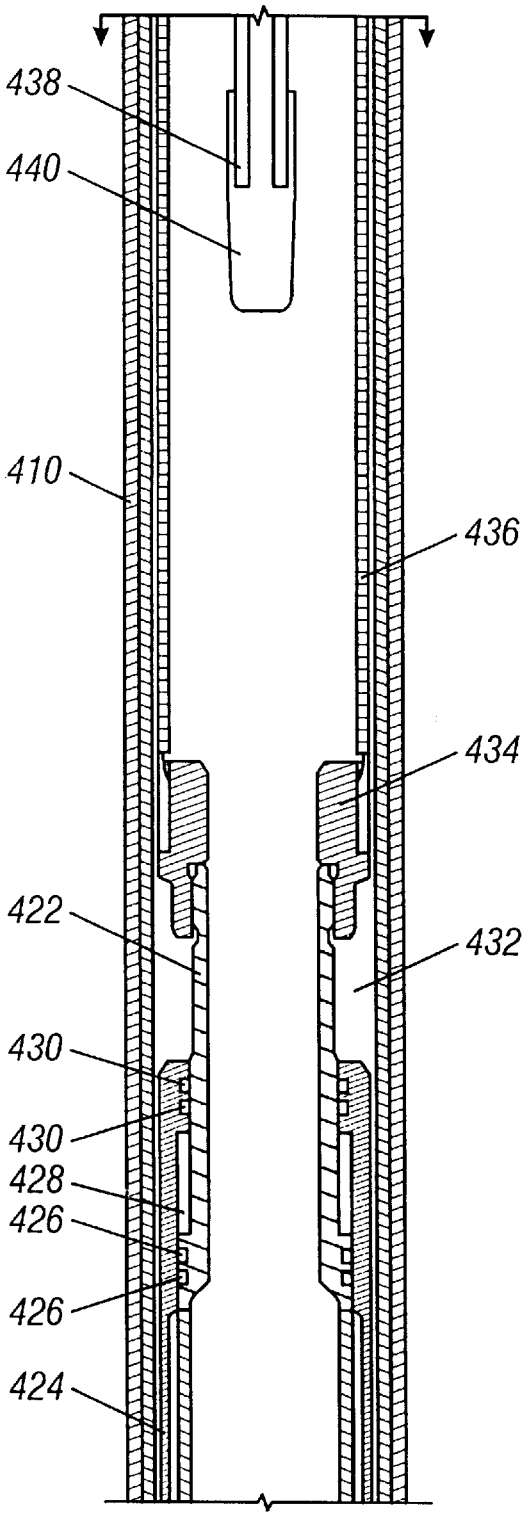

Referring further to FIGS. 5, 6*a*, and 6*b*, portions of the mechanical release mechanism in the anchor 16 are described. In FIG. 5, the fishing tool 54 includes a fishing neck 300 for attachment to the support member 52 at the bottom of the perforating tool 35. The fishing neck 300 is threadably attached to the top portion of a core 304, with a screw 302 locking the fishing neck 300 to the core 304. The core 304 extends along the length of the fishing tool 54. A top sub 308 encloses a portion of the core 304, and a latch 306 is threaded onto the top sub 308 to retain the top sub in position with respect to the core 304.

A sleeve 332 is threadably connected to the bottom portion of the top sub 308. In addition, the bottom portion of the top sub 308 forms a cavity between the inner wall of the top sub and the outer wall of the core 304. A core spring 314 is located in the cavity. A spring retainer 318 sits below the core spring 314 to hold the core spring 314 in position. In addition, a second cavity is formed between the inner wall of the sleeve 332 and the outer wall of the spring retainer 318, in which is located a "dog spring" 312.

The bottom end of the top sub 308 abuts a ring 317 that encircles, and is slidable with respect to, the spring retainer 318. Thus, when the operator pushes down on the fishing tool 54, the top sub 308 is movable downwards as the core spring 314 and the dog spring 312 compresses.

The spring retainer 318 sits on a shoulder 328 formed in the core 304. The top end of a collet sleeve 316 abuts the dog spring 312. The collet sleeve 316 encloses the bottom portion of the core 304. An inner ridge 334 extends from the inner wall of the collet sleeve 316, contacting the outer wall of the core 304 to create space between the collet sleeve 316 and the core 304. Release fingers 322, which are integrally attached to the collet sleeve 316, extend to the bottom of the fishing tool 54.

When the dog spring 312 is in its relaxed position, a flange 340 formed at the bottom ends of release fingers 322 sits on a shoulder 336 formed in a support ring 326. However, as the fishing tool 54 is pushed into the anchor 16 and the lower surface 338 of the flange 340 contacts the top end of a retainer sleeve 406 (FIG. 6*a*), the release fingers 322 are pushed upwards, further compressing the dog spring 312. When the release fingers 322 are pushed up above the support ring 326, they collapse to the external wall of the core 304, thereby reducing the effective diameter of the bottom portion of the release fingers 322. This allows the release fingers 322 to fit through the retainer sleeve 406 in the anchor 16. After the flange 340 formed at the bottom end of the release fingers 322 is passed through the retainer sleeve 406, the dog spring 312 pushes the release fingers 322 back onto the support ring 326. The flange 340 then locks the fishing tool 54 in the retainer sleeve 406 of the anchor 16.

As shown in FIGS. 6*a* and 6*b*, the fishing tool 54 is locked in the locking sleeve 60 inside the anchor 16. The flange 340 formed by the release fingers 322 are pushed through an inner flange 402 at the top end of the retainer sleeve 406. After the release fingers 322 are pushed inside the retainer sleeve 406, the flange 340 formed by the release fingers 322 and the flange 402 of the retainer sleeve 406 lock the fishing tool 54 inside the anchor 16.

A support band 320 attached around the collet sleeve 316 supports the fishing tool 54 against a corresponding support member 400 in the anchor 16. The support member 400 is threadably connected to a tubular member 414 inside a top housing section 404 of the anchor 16. The top housing section 404 is threadably connected to a connector piece 408, which in turn is connected to a middle housing section 410 of the anchor 16. The tubular member 414 is bolted to the connector piece 408 by bolts 409.

The retainer sleeve 412 is screwed to the tubular member 414 by shear screws 412. The shear screws 412 are configured such that if a sufficient force is applied by pulling the fishing tool 54 upwards (or alternatively, pushing the tool downwards), the shear screws 412 will break.

The bottom portion of the retainer sleeve 406 is attached to a retainer piece 420 by screws 418. The retainer piece 420 includes an upset portion 416, which is bent towards the center of the anchor 16. The upset position 416 fits over the upper portion of an inner piston 422, which is also threadably connected to the bottom portion of the tubular member 414. The tubular member 414 is further threadably connected to the top portion of an outer piston 424. While the upset portion 416 of the retainer piece 420 presses the inner piston 422 against the tubular member 414, the threaded connections among the tubular member 414, the outer piston 424, and the inner piston 422 remain intact to prevent relative movement with respect to one another.

As further shown in FIG. 6*b*, an air chamber 428 is formed between the inner and outer pistons 422 and 424. The air chamber 428 is sealed by seals 426 and 430 in the inner and outer pistons, respectively. A chamber 432 underneath the outer piston 424 is filled with well fluid when the anchor 16 is positioned downhole. The differential pressure between the well fluid in the chamber 432 and the air chamber 428 causes pressure to be applied upwards against the outer piston 424. However, as long as the retainer piece 420 sits over the top portion of the inner piston 422, relative motion of the inner and outer pistons 422 and 424 is prevented.

At its bottom end, the inner piston 422 is threadably connected to a transition connector 434, which is further threadably connected to a tube 436. Lower in the anchor 16, a detonator 440 is attached to detonating cords 438. In an alternative configuration, the detonator 440 can be attached to a detonating cord run from the perforating gun 27 through the bore of the anchor 16. Igniting the detonator 440 causes a detonating wave to be created in the detonating cord 438, which activates the ballistic release mechanism in the anchor 16 (with one example described in U.S. Pat. No. 5,429,192, reference above).

To activate the mechanical release mechanism in the anchor 16 (after the perforating gun 27 has been fixed to create the desired perforations), an operator at the well surface pulls up on the fishing tool 54. This causes the flange 340 of the release fingers 322 in the fishing tool 54 to pull up against the flange 402 of the retainer sleeve 406. If a sufficient force is applied in lifting the fishing tool 54, the shear screws 412 break, and the assembly including the retainer sleeve 406 and the retainer piece 420 is lifted upwards. Once the retainer piece 420 is moved away from the upper portion of the inner piston 422, the threaded connection between the inner piston 422 and the bottom portion of the tubular member 414 is no longer supported. As a result, the differential pressure between the chamber 432 and the air chamber 428 pushes the outer piston 424 upwards. The entire assembly including the middle housing section 410, the connector piece 408, and the top housing section 404 are pushed upwards by the differential pressure applied against the outer piston 424. Movement of the outer piston 424 reduces the volume of the air chamber 428. When the housing section 410 is moved by a sufficient distance, the anchor slip 62 is allowed to retract to unset the anchor 16. An example of this mechanical release mechanism is described in U.S. Pat. No. 5,429,192, referenced above.

The azimuth-oriented perforating system described allows an operator to accurately aim a perforating gun in a single plane. Using an anchor to define the reference direction, a reliable method has been developed for orienting a perforating gun in a selected direction.

Other embodiments are also within the scope of the following claims. For example, instead of using two separate runs to set the anchor, to measure the orientation of the reference slot in the anchor, and to fire the perforating gun, the steps can all be combined into one run to further save cost and time. Alternatively, the steps can be performed in multiple runs (greater than two) if desired.

Figure 7:
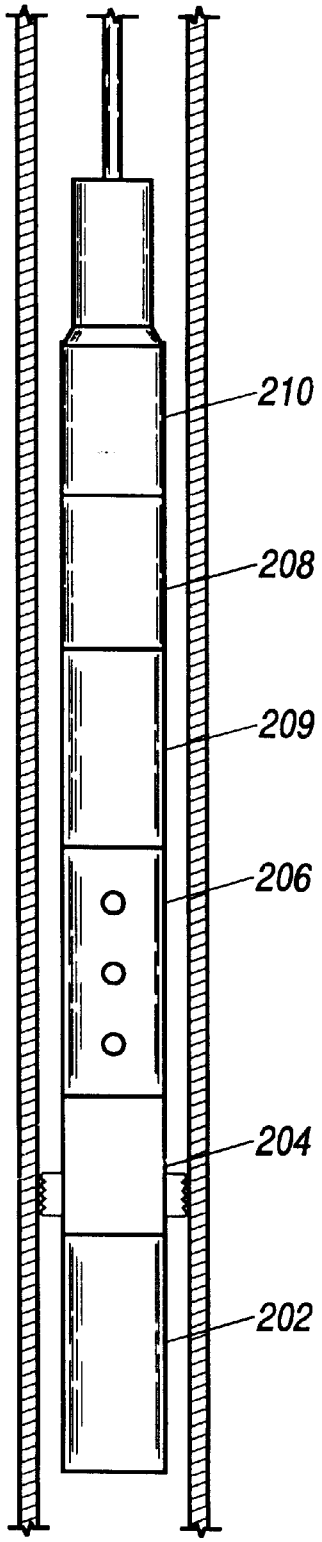
FIG. 7 is an alternative diagram of a perforating apparatus that can be oriented to perforate in a selected direction.

Referring to FIG. 7, an alternative tool string that can perform the steps in one run includes a setting apparatus 202 at the bottom of the tool string. An anchor 204 is attached above the anchor setting apparatus 202, and a perforating gun 206 is connected above the anchor 204. A firing head 209 is attached above the perforating gun 206. The perforating gun 206 is rotatable with respect to the anchor 204 to allow proper adjustment of the direction of the shaped charges in the perforating gun 206. A gyroscope 208 is attached above the firing head 209, and a CCL 210 is attached above the gyroscope 208.

After the anchor 204 has been set by the anchor setting apparatus 202, the gyroscope 208 is used to measure the azimuth direction of the tool string with respect to the magnetic north. After the measurement has been taken, the perforating gun string 206 is rotated inside the anchor 204 to point in the direction of the preferred fracture plane. After the gun string 206 has been rotated to point in the proper direction, the gyroscope 208 is activated again to measure the azimuth direction to ensure that the perforating gun 206 has been properly set. Next, the gyroscope 208 is mechanically released from the firing head 209, but an electrical connection remains intact from the gyroscope to the firing head. Next, the perforating gun 206 is fired by electrical activation of the firing head 209. The shock created by firing the perforating gun 206 does not damage the gyroscope 208 as the two components are not mechanically attached upon firing.

Alternatively, instead of releasing the gyroscope 208 from the firing head 209, a shock absorber can be located between the firing head 209 and gyroscope to reduce the amount of shock to the gyroscope.

After the gun 206 is fired, the anchor 204 is released (either ballistically or mechanically), and the entire tool string can be retrieved. All equipment except the gun string 206 are reusable, including the anchor setting apparatus 202, the anchor 204, the gyroscope 208, and the CCL 210. By reducing the number of runs required to perform azimuth-oriented perforating and by reusing equipment, a further significant reduction in cost and time can be achieved.

What is claimed is:

1. An apparatus for performing oriented perforating in a wellbore, comprising:

an anchor having a first reference terminal;

a gyroscope for measuring the azimuth orientation of the first reference terminal; and a perforating tool attached to a second reference terminal, the second reference terminal adapted to cooperate with the first reference terminal to orient the perforating tool to perform oriented perforating.

2. The apparatus of claim 1, wherein the gyroscope measurement occurs in a first run in the wellbore and the perforating tool orientation occurs in a second, separate run.

3. The apparatus of claim 1, wherein the gyroscope measurement and perforating tool orientation are performed in a single run in the wellbore.

4. A method of azimuthally orienting a perforating tool in a wellbore, comprising:

setting an anchor having a reference terminal;

measuring the azimuth orientation of the reference terminal; and coupling the perforating tool to the reference terminal to orient the perforating tool in a desired azimuth orientation.

5. The method of claim 4, wherein the azimuth orientation of the reference terminal is measured by a gyroscope.

6. The method of claim 4, further comprising:

adjusting relative positions of a perforating device in the perforating tool and a second reference terminal attached to the perforating tool for orienting the perforating tool in the desired azimuth orientation once the second reference terminal is coupled to the anchor reference terminal.

7. The method of claim 4, wherein the perforating tool includes charges, the perforating tool being attached to a second reference terminal, the method further comprising:

adjusting the direction of the charges with respect to the second reference terminal; and coupling the second reference terminal to the anchor reference terminal to orient the charges to perforate in one or more azimuth directions.

8. The method of claim 7, further comprising arranging the charges to perforate along a desired fracture plane.

9. The method of claim 8, comprising arranging the charges to perform 0°- or 180°-phased perforating.

10. An oriented perforating system for use in a wellbore, comprising:

a perforating gun;

a first reference element in a known relation to the perforating gun;

an anchor set in the wellbore, the anchor having a second reference element adapted to mate with the first reference element; and a measurement device to measure the azimuthal orientation of the second reference element so that the perforating gun is orientable to a desired azimuthal position in the wellbore.

11. A method of performing oriented perforating in a wellbore, comprising:

setting a component having a first reference element in the wellbore;

determining the azimuthal position of the first reference element in the wellbore; and lowering a perforating tool having a second reference element into the wellbore, the first and second reference elements being adapted to cooperate to orient the perforating tool to a desired azimuth orientation.

12. The method of claim 1, further comprising adjusting the azimuthal position of a perforating gun in the perforating tool with respect to the second reference element.

13. An oriented perforating apparatus, comprising:

an anchor having a first reference element;

a measurement device to measure the azimuthal orientation of the first reference element; and a second reference element adapted for attachment to a perforating device and for cooperation with the first reference element to orient the perforating device in a desired azimuthal orientation.

14. The apparatus of claim 13, wherein the first reference element includes a female reference slot, and the second reference element includes a male reference member.

15. The apparatus of claim 13, wherein the measurement device includes a gyroscope to measure the direction of the first reference element with respect to north.

16. The apparatus of claim 15, wherein the second reference element is adjustable to face in a direction based on the measurement taken by the gyroscope.

* * * * *